US007556591B2

(12) United States Patent
Chuang et al.

(10) Patent No.: US 7,556,591 B2
(45) Date of Patent: Jul. 7, 2009

(54) STATIONARY EXERCISE DEVICE

(76) Inventors: Jin Chen Chuang, No. 17, Lane 301, Nanyang Road, Fong Yuan, Taichung Hsien 42083 (TW); Lung Fei Chuang, No. 17, Lane 301, Nanyang Road, Fong Yuan, Taichung Hsien 42083 (TW)

( * ) Notice: Subject to any disclaimer, the term of this patent is extended or adjusted under 35 U.S.C. 154(b) by 0 days.

(21) Appl. No.: 11/787,752

(22) Filed: Apr. 17, 2007

(65) Prior Publication Data

US 2008/0261779 A1 Oct. 23, 2008

(51) Int. Cl.
*A63B 22/00* (2006.01)
*A63B 69/16* (2006.01)

(52) U.S. Cl. ..... 482/52; 482/57; 482/51

(58) Field of Classification Search ..... 482/51–53, 482/57, 70, 79–80
See application file for complete search history.

(56) References Cited

U.S. PATENT DOCUMENTS 5,290,211 A 3/1994 Stearns ..... 482/53
5,499,956 A 3/1996 Habing et al. ..... 482/52
5,577,985 A * 11/1996 Miller ..... 482/52
5,595,553 A 1/1997 Rodgers, Jr. ..... 482/51
5,769,760 A * 6/1998 Lin et al. ..... 482/52
5,911,649 A * 6/1999 Miller ..... 482/52
5,921,894 A * 7/1999 Eschenbach ..... 482/57
6,022,296 A * 2/2000 Yu ..... 482/52
6,024,676 A * 2/2000 Eschenbach ..... 482/51
6,045,487 A * 4/2000 Miller ..... 482/52
7,104,929 B1 * 9/2006 Eschenbach ..... 482/52

* cited by examiner

*Primary Examiner*—Steve R Crow
(74) *Attorney, Agent, or Firm*—Charles E. Baxley

(57) ABSTRACT

An exercise device includes two cranks rotatably coupled to a rear portion of a upright support and each having a pivot rod, two handles having a middle portion pivoted to a front portion of the upright support with a spindle, two foot supports pivotally coupled to the handles and each having a middle portion pivotally coupled to the pivot rod of the cranks with a link, and two levers pivotally coupled to the pivot rod and the handle and spaced away from the spindle for forming a polygonal coupling structure and for allowing the foot supports to be controlled by both the cranks and the link and the handles, and for allowing the foot supports to be moved elliptically relative to the upright support of the base.

1 Claim, 6 Drawing Sheets

STATIONARY EXERCISE DEVICE

BACKGROUND OF THE INVENTION

1. Field of the Invention

The present invention relates to a stationary exercise device, and more particularly to an elliptical exercise device including an arrangement for allowing the exercise device to have an increased or different moving stroke.

2. Description of the Prior Art

Typical exercise devices, such as stepping exercisers comprise a pair of handles pivotally attached to an upwardly extending frame member of a base support device, and a pair of foot supports pivotally coupled to the handles and arranged for allowing the foot supports to be stepped or moved up and down relative to the base support device.

For example, U.S. Pat. No. 5,290,211 to Stearns discloses one of the typical exercise devices also comprising a pair of handles pivotally attached to an upwardly extending frame member of a base support device, and a pair of foot supports pivotally coupled to the handles, and a pair of force resisting device pivotally coupling the foot supports to the upwardly extending frame member for allowing the foot supports to be stepped or moved up and down relative to the base support device.

However, normally, the middle portion of the foot supports is pivotally coupled to the upwardly extending frame member such that the middle portion of the foot supports is pivoted relative to the base support device but may not be moved cyclically or in reciprocating relative to the base support device, and such that the moving stroke of the typical exercise devices may not be suitably increased.

U.S. Pat. No. 5,499,956 to Habing et al. discloses a typical articulated lower body exercise device comprising a pair of foot supports pivotally coupled to the upwardly extending frame member of a base support device with a pair of vertical linkage arms, and a device for swinging the vertical linkage arms and the foot supports relative to the upwardly extending frame member of the base support device for allowing the foot supports to be stepped or moved elliptically relative to the base support device.

However, the middle portion of the foot supports is only pivoted relative to the base support device but may not be moved cyclically or in reciprocating relative to the base support device, and such that the moving stroke of the typical exercise devices may not be suitably increased.

U.S. Pat. No. 5,577,985 to Miller discloses a typical stationary exercise device comprising a pair of guide links or handles pivotally attached to an upright support, and a pair of foot supports each pivotally coupled to the handles, and a pair of cranks pivotally coupled to the handles and the foot supports with an intermediate link and a control link, for swinging the handles and the foot supports relative to the base support device and for allowing the foot supports to be stepped or moved elliptically relative to the base support device.

However, the middle portion of the foot supports is only pivotally coupled to the handles, and may not be moved cyclically or in reciprocating relative to the base support device such that the moving stroke of the typical exercise devices may not be suitably increased or adjusted.

U.S. Pat. No. 5,595,553 to Rodgers, Jr. discloses another typical stationary exercise device also comprising a pair of handles pivotally attached to an upright support, and a pair of foot supports each pivotally coupled to the handles, and a pair of cranks pivotally coupled to the foot supports with a reciprocating member for swinging the handles and the foot supports relative to the base support device and for allowing the foot supports to be stepped or moved elliptically relative to the base support device.

However, similarly, the foot supports is only pivotally coupled to the handles, and may not be moved cyclically or in reciprocating relative to the base support device such that the moving stroke of the typical exercise devices may not be suitably increased or adjusted.

U.S. Pat. No. 5,769,760 to Lin et al. discloses a further typical stationary exercise device comprising a pair of foot supports including a front portion pivotally coupled to an upright support, and a pair of handles also pivotally attached to the upright support, and a pair of cranks pivotally coupled to the handles for swinging the handles and the foot supports relative to the base support device and for allowing the foot supports to be stepped or moved elliptically relative to the base support device.

However, the handles are located closer to the users, and are pivotally coupled to the upright support and may also be moved cyclically relative to the upright support of the base support device such that the handles will also be moved cyclically relative to the upright support and such that the handles may not be suitably or easily grasped and handled by the users.

U.S. Pat. No. 6,022,296 to Yu discloses a further typical stepping exercise device comprising a pair of handles pivotally coupled to an upright support with a pair of cranks, and a pair of foot supports including a middle portion pivotally attached to the base support and including a front portion pivotally coupled to the handles.

However, the foot supports are only coupled to the upright support or the base support such that the foot supports may only be stepped or moved up and down relative to the base support device, but may not be stepped or moved elliptically relative to the upright support of the base support device.

The present invention has arisen to mitigate and/or obviate the afore-described disadvantages of the conventional elliptical exercise devices.

SUMMARY OF THE INVENTION

The primary objective of the present invention is to provide an exercise device including an arrangement for allowing the exercise device to have an increased moving stroke.

In accordance with one aspect of the invention, there is provided an exercise device comprising a base including an upright support extended upwardly from the base, the upright support including a front portion and a rear portion, a spindle disposed on the front portion of the upright support, two cranks rotatably coupled to the rear portion of the upright support with a shaft, the cranks each including a pivot rod attached to the crank and spaced away from the shaft, two handles including a middle portion attached to the spindle for allowing the handles to be pivotally coupled to the front portion of the upright support with the spindle and for allowing the handles to be pivoted and swung relative to the upright support of the base, the handles each including a hand grip provided on an upper portion for being grasped or held by a user and each including a lower portion, two foot supports each including a front portion pivotally coupled to the lower portion of the handles, and each including a foot pedal disposed on a rear portion for supporting the user's feet, and each including a middle portion pivotally coupled to the pivot rod of the cranks with a link for allowing the middle portions of the foot supports to be moved cyclically relative to the upright support of the base by the cranks, and two levers each including a first end pivotally coupled to the pivot rod of the crank, and each including a second end coupled to the middle portion of the handle and spaced away from the spindle for forming a polygonal coupling structure together with the handles and the foot supports and the links, and for allowing the foot pedals of the foot supports to be moved elliptically relative to the upright support of the base.

The second ends of the levers are each coupled to the middle portions of the handles respectively with a securing device. The handles each include an orifice formed in the middle portion of the handle for engaging with the securing device.

A resisting device may further be provided for resisting a rotational movement of the shaft and the cranks. The resisting device includes a wheel rotatably attached to the rear portion of the upright support with the shaft. The resisting device includes a rotary member rotatably attached to the upright support with an axle and coupled to the wheel.

A follower may further be provided and attached to the axle and moved in concert with the axle, and the follower is coupled to the wheel with a coupling device. For example, the coupling device may be a belt. A flywheel may further be provided and rotatably attached to the upright support with a pivot rod and coupled to the rotary member with a coupling device which may also be a belt.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
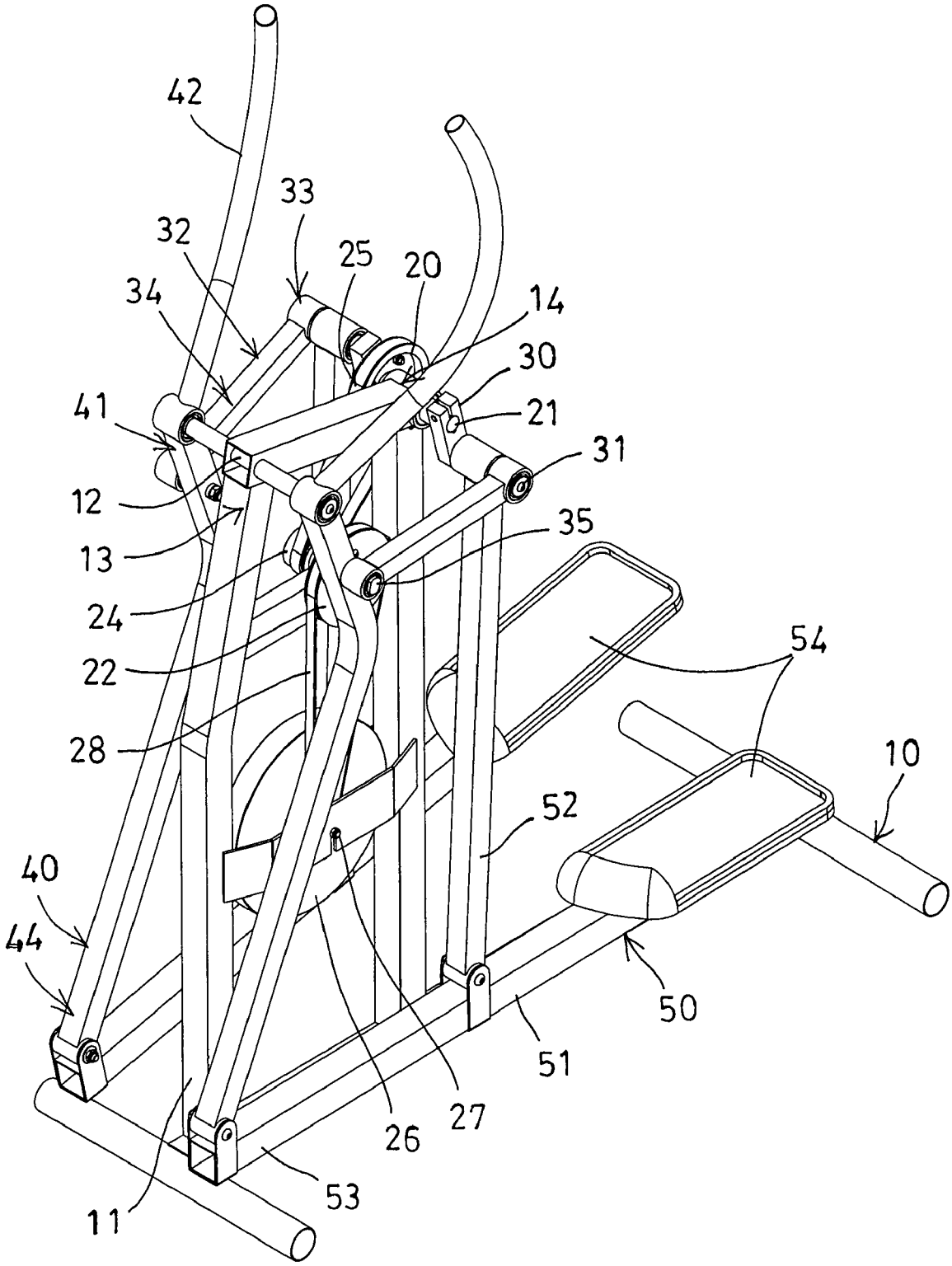
FIG. 1 is a front perspective view of an exercise device in accordance with the present invention.
Figure 2:
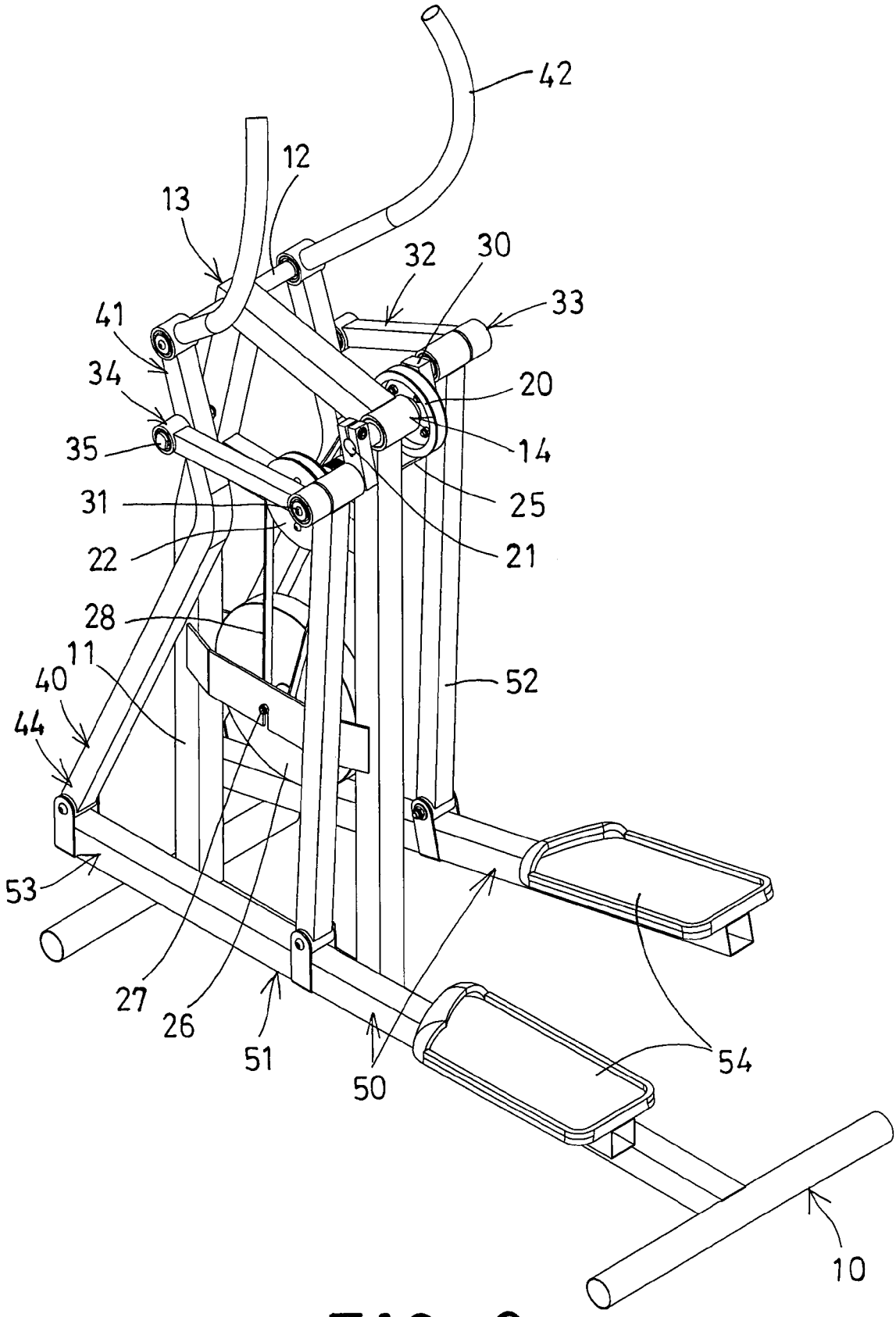
FIG. 2 is a rear perspective view of the exercise device.
Figure 3:
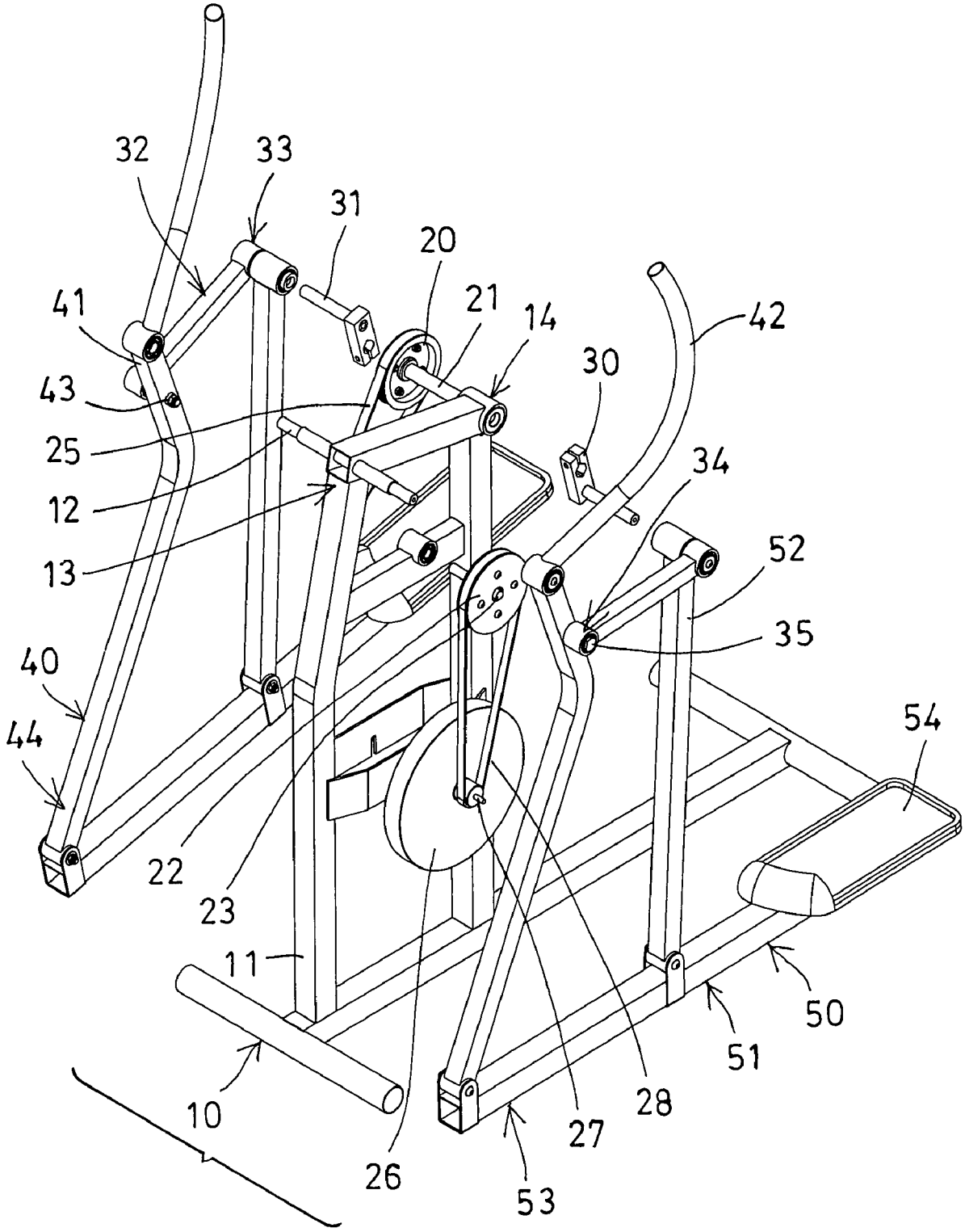
FIG. 3 is a partial exploded view of the exercise device as seen from the front portion of the exercise device.
Figure 4:
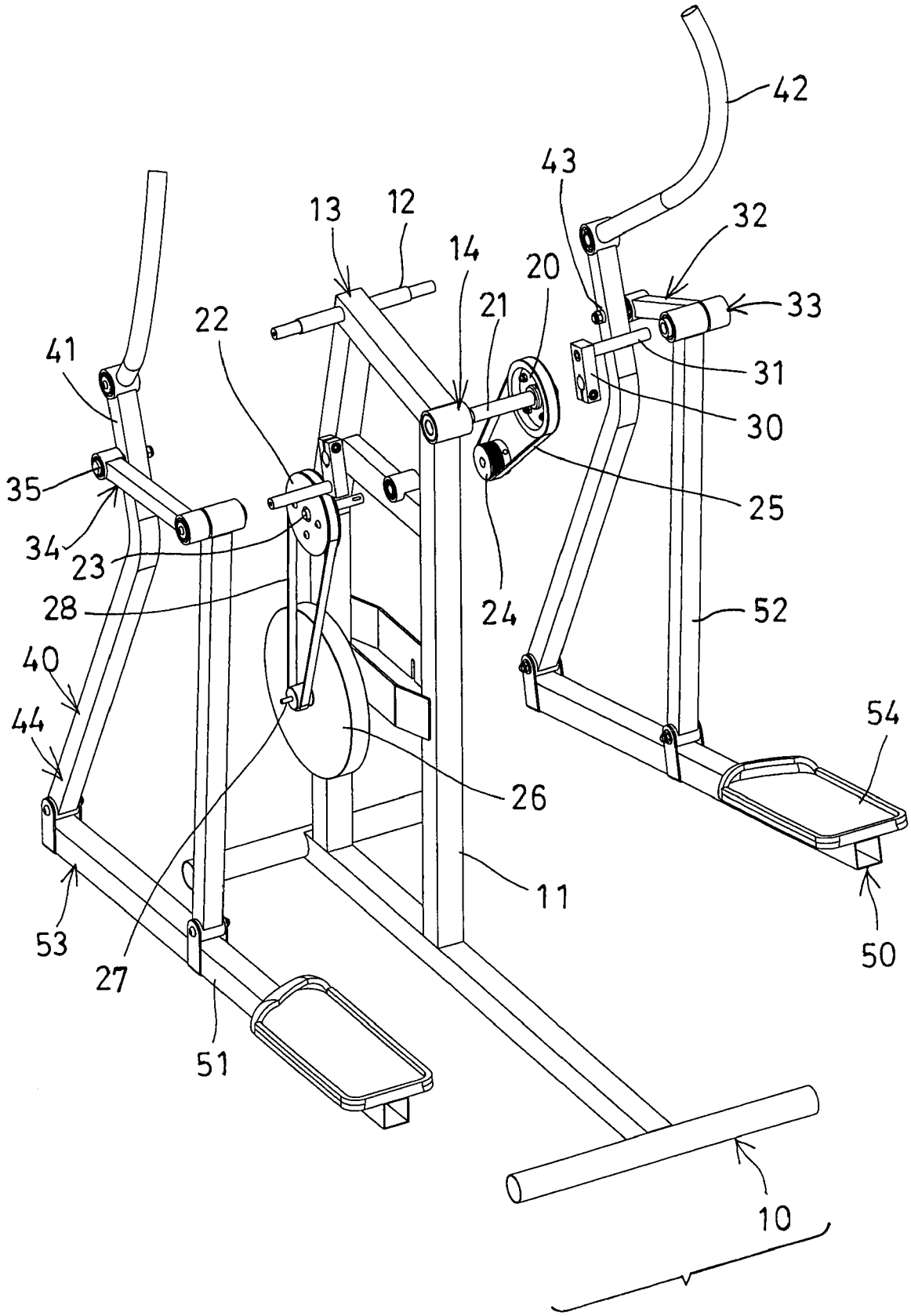
FIG. 4 is a partial exploded view of the exercise device as seen from the rear portion of the exercise device.
Figure 5:
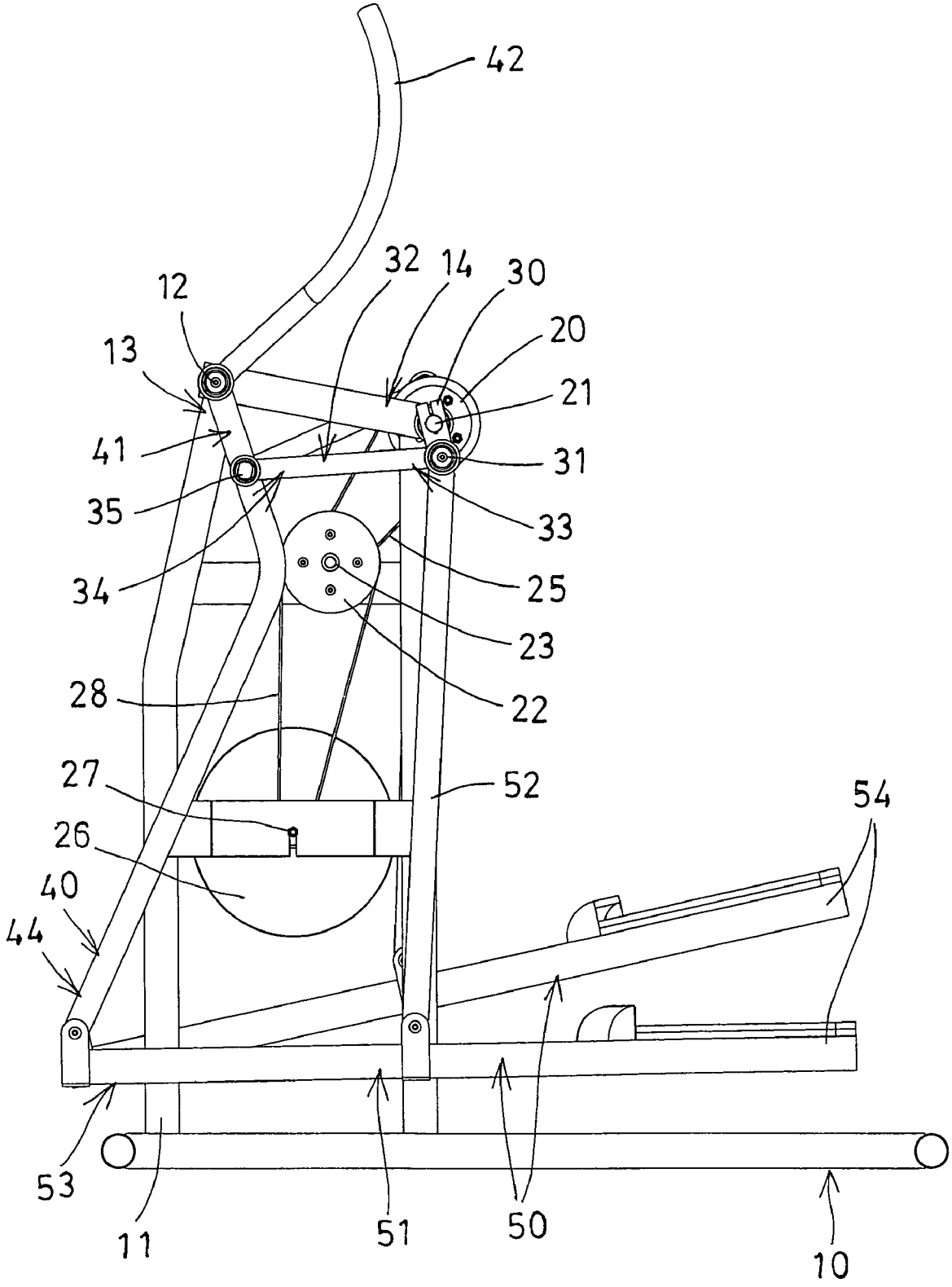
FIG. 5 is a side plan schematic view of the exercise device.
Figure 6:
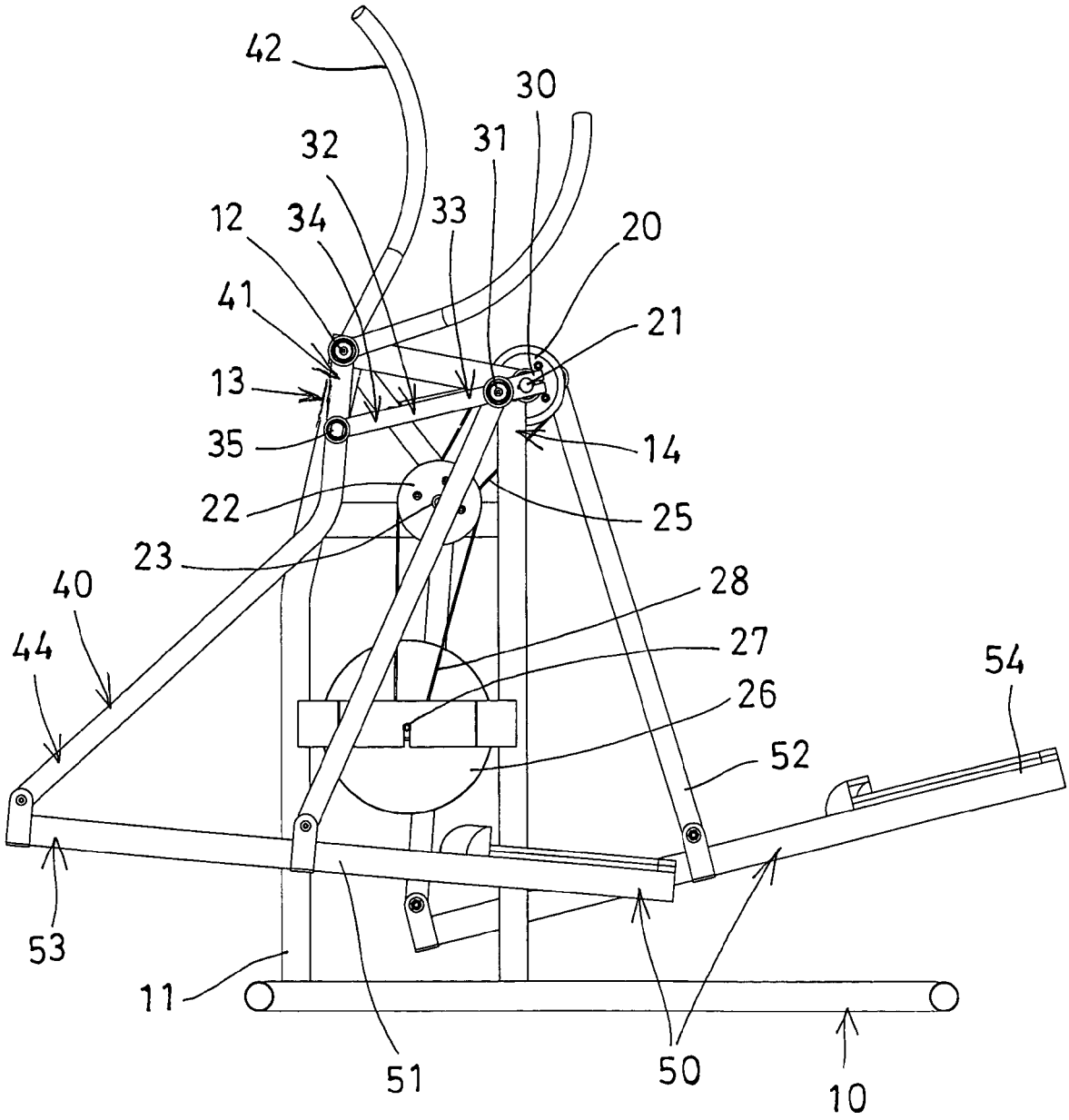
FIG. 6 is a side plan schematic view similar to FIG. 5, illustrating the operation of the exercise device.

Referring to the drawings, and initially to FIGS. 1-5, an exercise device 1 in accordance with the present invention comprises a base 10, an upright support 11 extended upwardly from the base 10, a spindle 12 disposed or provided on the front portion 13 of the upright support 11, a rotary member or pulley or wheel 20 rotatably attached to the rear portion 14 of the upright support 11 with a shaft 21, another wheel or pulley or rotary member 22 rotatably attached to the middle portion of the upright support 11 with an axle 23, a further wheel or rotary member or pulley or follower 24 attached or secured to the axle 23 and, moved in concert with the axle 23, and the follower 24 is coupled to the wheel 20 with a coupling device 25, such as a sprocket-and-chain coupling device or a gearing coupling device (not shown), or a belt 25 for allowing the follower 24 and the rotary member 22 to be rotated or driven by the wheel 20.

A weight or flywheel 26 may further be provided and attached to the middle or lower portion of the upright support 11 with a pivot rod 27 which is coupled to the rotary member 22 with another coupling device 28, such as a sprocket-and-chain coupling device or a gearing coupling device (not shown), or a belt 28 for allowing the flywheel 26 to be rotated or driven by the follower 24 and the rotary member 22 that are rotated or driven by the wheel 20. The follower 24 and the rotary member 22 and/or the flywheel 26 may apply a resistive force against the wheel 20 and the shaft 21 for resisting the rotational movement of the wheel 20 and the shaft 21. It is to be noted that the flywheel 26, the follower 24, the rotary member 22, the wheel 20 and the shaft 21 are coupled together to form a resistive means or device for resisting the rotational movement of the wheel 20 and the shaft 21, however, the other resistive device, such as the hydraulic or pneumatic resistive devices (not shown), or the magnetic retarding devices (not shown) may also be used to apply the resistive force against the wheel 20 and the shaft 21.

A pair of or two cranks 30 are secured to the shaft 21 such that the cranks 30 may be rotatably coupled to the rear portion 14 of the upright support 11 with the shaft 21, the cranks 30 each include a pivot rod 31 provided or attached thereto or extended outwardly therefrom and spaced away from or distal to the shaft 21, a pair of or two handles 40 include an upper or middle portion 41 attached or secured to the spindle 12 for allowing the handles 40 to be pivotally coupled to the front portion 13 of the upright support 11 with the spindle 12 and for allowing the handles 40 to be pivoted or swung relative to the upright support 11 of the base 10. The handles 40 each include a hand grip 42 formed or provided on the upper portion thereof for being grasped or held or operated by the users.

A pair of or two foot supports 50 each include a middle portion 51 pivotally coupled to the pivot rod 31 of the cranks 30 with a link 52 for allowing the middle portions 51 of the foot supports 50 to be moved cyclically relative to the upright support 11 of the base 10 by the cranks 30, and each include a front portion 53 pivotally coupled the lower portion 44 of the handles 40 respectively for allowing the foot supports 50 and the handles 40 to be pivotally coupled or attached to the upright support 11 of the base 10, and for allowing the foot supports 50 and the handles 40 to be moved or pivoted or swung relative to the upright support 11 of the base 10. The foot supports 50 each include a foot pedal 54 disposed or provided on the rear portion thereof for supporting the feet of the users and for allowing the feet of the users to step and to operate or to actuate the foot supports 50.

A pair of or two arms or levers 32 may further be provided, and each include one end or first end or rear portion 33 pivotally coupled to the pivot rod 31 of the cranks 30, and each include the other end or second end or front portion 34 pivotally coupled to an orifice 43 (FIGS. 3, 4) of the middle portions 41 of the handles 40 with a fastener or securing device 35 which is spaced away from the spindle 12, for forming a polygonal pivot coupling structure together with the handles 40 and the foot supports 50 and the links 52. For example, the securing device 35 may be selectively coupled to the suitable or selected position of the middle portions 41 of the handles 40 respectively with the securing device 35, for determining the distance between the spindle 12 of the upright support 11 and the front portion 34 of the levers 32, and for forming the polygonal pivot coupling structure with the handles 40 and the cranks 30 and/or the link 52 and the foot supports 50, and thus for determining the moving strokes of the foot supports 50. For example, the moving stroke of the foot supports 50 may be greater when the front portion 34 of the levers 32 are located and secured closer to the spindle 12 of the upright support 11, and may be smaller when the front portion 34 of the levers 32 are located and secured farther away from the spindle 12 of the upright support 11.

In operation, the handles 40 and the front portion 53 of the foot supports 50 may pivoted or swung relative to the upright support 11 of the base 10 with the spindle 12 of the upright support 11, and the middle portions 51 of the foot supports 50 may be moved cyclically relative to the upright support 11 of the base 10 by the cranks 30, such that the foot pedals 54 of the foot supports 50 may be moved elliptically relative to the upright support 11 of the base 10. It is to be noted that the provision and the coupling of the levers 32 between the handles 40 and the cranks 30 and/or the link 52 may form a polygonal pivot coupling structure together with the handles 40 and the foot supports 50 and the links 52 for allowing the swinging stroke of the handles 40 to be controlled or determined by the rotational movement of the cranks 30, and also for allowing the moving stroke of the foot supports 50 to be controlled or determined by the rotational movement of the cranks 30.

The provision and the coupling of the wheel 20, and the rotary member 22, and the follower 24, and the flywheel 26 may be formed or acted as a resisting means or device for applying a resistive force or a retarding force against the wheel 20 and the shaft 21 and thus the cranks 30 and the link 52 and the foot supports 50 and the levers 32 and the handles 40, and thus for resisting the rotational movement of the wheel 20 and the shaft 21 and the cranks 30 and also for resisting the swinging movement of the link 52 and the handles 40. A magnetic retarding device (not shown) may further be provided and coupled to the wheel 20 and/or the rotary member 22 and/or the follower 24 and/or the flywheel 26 for further applying a resistive force against the wheel 20 and/or the rotary member 22 and/or the follower 24 and/or the flywheel 26 and for further resisting the swinging movement of the link 52 and the handles 40.

The front portion 34 of the levers 32 may be adjusted closer to or farther away from the spindle 12 of the upright support 11 in order to adjust the swinging stroke of the handles 40 and the moving stroke of the foot supports 50. However, the adjustable structure of front portion 34 of the levers 32 relative to the middle portions 41 of the handles 40 has been filed in the other co-pending U.S. patent applications and will not be described in further details.

Accordingly, the exercise device in accordance with the present invention includes an arrangement for allowing the exercise device to have an increased moving stroke.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An exercise device comprising:

a base including an upright support extended upwardly from said base and including a front portion and a rear portion, a spindle disposed on said front portion of said upright support, two cranks rotatably coupled to said rear portion of said upright support with a shaft, said spindle being spaced from said shaft and located in front of said shaft and said cranks, said cranks each including a rigid pivot rod attached to said crank and spaced away from said shaft, two handles including a middle portion attached to said spindle for allowing said handles to be pivotally coupled to said front portion of said upright support with said spindle and for allowing said handles to be pivoted and swung relative to said upright support of said base, said handles each including a hand grip provided on an upper portion for being grasped or held by a user and each including a lower portion, and each including an orifice formed in said middle portion of said handle, two foot supports each including a front portion pivotally coupled to said lower portion of said handles, and each including a foot pedal disposed on a rear portion for supporting said user's feet, and each including a middle portion pivotally directly coupled to said pivot rod of said cranks with a link for allowing said middle portions of said foot supports to be moved cyclically relative to said upright support of said base by said cranks, two levers each including a first end pivotally coupled to said pivot rod of said crank, and each including a second end coupled to said middle portion of said handle and spaced away from said spindle for forming a polygonal coupling structure together with said handles and said foot supports and said links, and for allowing said foot pedals of said foot supports to be moved elliptically relative to said upright support of said base, a securing device engaged with said second end of each lever and engaged with said orifice of each handle for coupling said second ends of said levers to said handles respectively, a wheel rotatably attached to said rear portion of said upright support with said shaft, a rotary member rotatably attached to said upright support with an axle and coupled to said wheel, a follower attached to said axle and moved in concert with said axle and coupled to said wheel, and a flywheel rotatably attached to said upright support with a pivot rod and coupled to said rotary member.

* * * * *